US010076850B2

(12) United States Patent
Campana, Sr.

(10) Patent No.: US 10,076,850 B2
(45) Date of Patent: Sep. 18, 2018

(54) LOG SPLITTER APPARATUS AND METHOD

(71) Applicant: Iron Arc, LLC, Lorain, OH (US)

(72) Inventor: Michael A. Campana, Sr., Amherst, OH (US)

(73) Assignee: Iron Arc, LLC, Lorain, OH (US)

( * ) Notice: Subject to any disclaimer, the term of this patent is extended or adjusted under 35 U.S.C. 154(b) by 240 days.

(21) Appl. No.: 15/085,341

(22) Filed: Mar. 30, 2016

(65) Prior Publication Data

US 2016/0288362 A1 Oct. 6, 2016

Related U.S. Application Data

(60) Provisional application No. 62/141,460, filed on Apr. 1, 2015.

(51) Int. Cl.
*B27L 7/06* (2006.01)
*B27L 7/00* (2006.01)

(52) U.S. Cl.
CPC ..... *B27L 7/06* (2013.01); *B27L 7/005* (2013.01)

(58) Field of Classification Search
CPC .... B27L 7/00; B27L 7/005; B27L 7/06; B27L 7/08
See application file for complete search history.

(56) References Cited

U.S. PATENT DOCUMENTS

| | | | | |
|---|---|---|---|---|
| 4,239,198 | A | 12/1980 | Trupp | |
| 4,445,555 | A | 5/1984 | Klempirik | |
| 4,515,195 | A | 5/1985 | Gladstein | |
| 4,535,980 | A | 8/1985 | Jordan | |
| 4,782,867 | A | 11/1988 | Forsyth | |
| 4,782,868 | A | 11/1988 | Coller et al. | |
| 4,782,870 | A * | 11/1988 | Duerr | B27L 7/00 144/193.1 |
| 4,926,558 | A | 5/1990 | Brace | |
| 7,096,901 | B2 | 8/2006 | Brazzola | |
| 2008/0251158 | A1 | 10/2008 | Koch | |
| 2013/0327443 | A1 | 12/2013 | Paden | |
| 2016/0107330 | A1 * | 4/2016 | Hutchinson | B27L 7/06 225/81 |

FOREIGN PATENT DOCUMENTS

| | | |
|---|---|---|
| DE | 102008016470 | 10/2009 |
| WO | 2014098622 | 6/2014 |

* cited by examiner

*Primary Examiner* — Matthew G Katcoff
(74) *Attorney, Agent, or Firm* — Rankin, Hill & Clark LLP

(57) ABSTRACT

A log splitter apparatus and method for splitting logs includes an upward facing wedge and a shroud secured to the upward facing wedge. The shroud can have a positioning aperture defined therein that is positioned over the upward facing wedge to position an associated log on the upward facing wedge for splitting of the associated log by the upward facing wedge when a downward force is applied to the associated log at an upper end of the associated log that is opposite a downward end positioned at or adjacent the upward facing wedge.

18 Claims, 6 Drawing Sheets

LOG SPLITTER APPARATUS AND METHOD

BACKGROUND

To prepare firewood for burning, logs are typically formed via cutting into log sections or billets of an appropriate or desired length (e.g., often somewhere between 12 inches and 48 inches in length). Each log section can then then be split into a desired size firewood piece. Splitting serves multiple purposes, including reducing the size of the log to something manageable and facilitating seasoning of the log prior to burning. For example, a tree may be cut down, and then cut log sections of desired lengths. Each log section can then be split, the split wood stacked, and finally seasoned for a year or so, sometimes longer, prior to burning.

Conventionally, each log section can be manually split by a person placing a log section onto a stump and then splitting the log section with an ax or appropriate splitting tool, such as a splitting maul. Sometimes, for large diameter sections, one or more wedges can be used to split the log section. As the person splits each log section, the split pieces, and sometimes even an entire log section, can fall to the ground, typically after each blow. Often, the split pieces must be picked up and repositioned on the stump for further splitting or an attempted re-split. This causes increased manual labor in that the log sections and/or partially split sections must continually be picked back up and repositioned for further splitting. Also, a constant struggle when manually splitting wood is maintaining the stability of the log section to be split. This struggle increases as the sections are partially split and become less stable for further splitting. Of course, power-splitting machines are well known, but these can be expensive and cumbersome.

SUMMARY

According to one aspect, a log splitter apparatus for splitting logs includes an upward facing wedge and a shroud secured to the upward facing wedge. The shroud can have a positioning aperture defined therein that is positioned over the upward facing wedge to position an associated log on the upward facing wedge for splitting of the associated log by the upward facing wedge when a downward force is applied to the associated log at an upper end of the associated log that is opposite a downward end positioned at or adjacent the upward facing wedge.

According to another aspect, a log splitter method is provided for splitting logs. In the method, a log splitter apparatus is provided having an upward facing wedge and a shroud secured to the upward facing wedge. A log to be split is positioned into a positioning aperture defined by the shroud over the upward facing wedge to position the log on the upward facing wedge for splitting thereof. Then, a downward force is applied to an upper end of the log to force the log downward into the upward facing wedge to split the log.

According to a further aspect, a splitter apparatus for splitting logs includes an upward facing wedge and a shroud connected to the upward facing wedge. The shroud defines a positioning aperture directly above the upward facing wedge and the shroud inhibits contact with the upward facing wedge.

DETAILED DESCRIPTION

Figure 3:
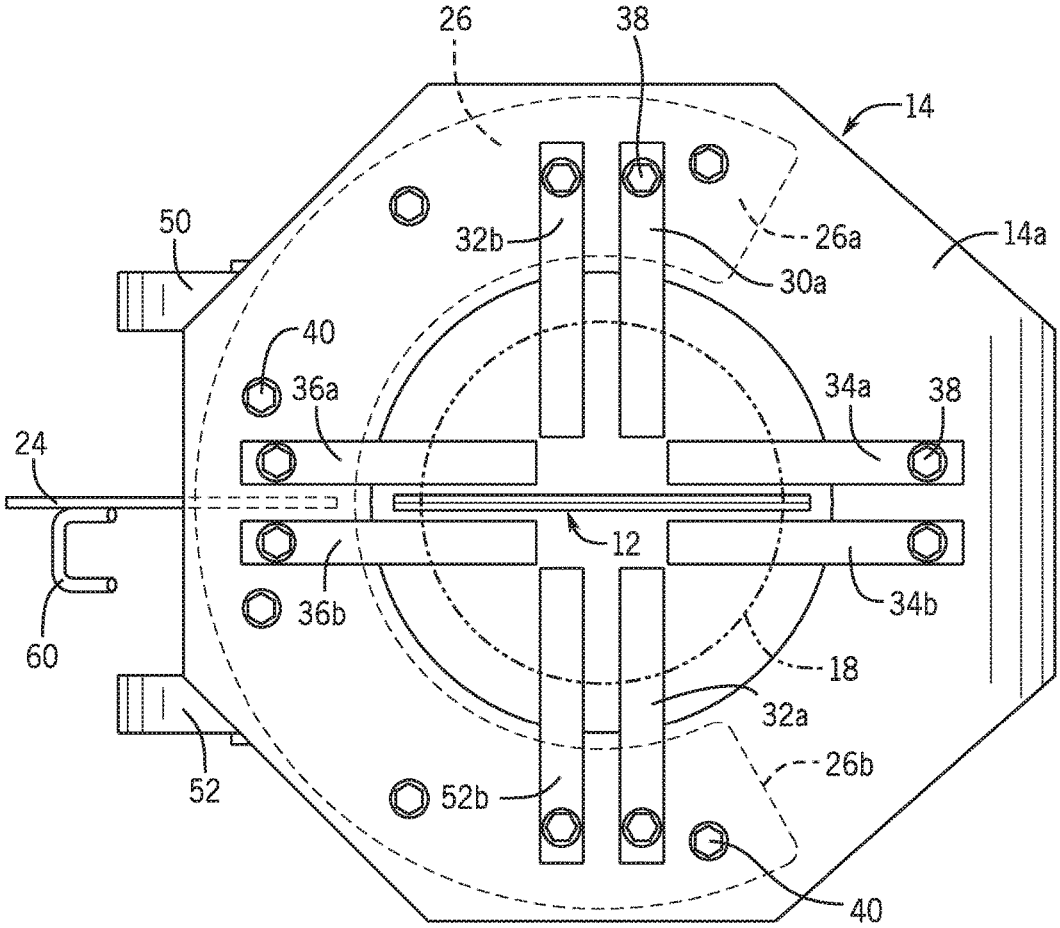
FIG. 3 is a top view of the log splitter apparatus of FIG. 1.
Figure 4:
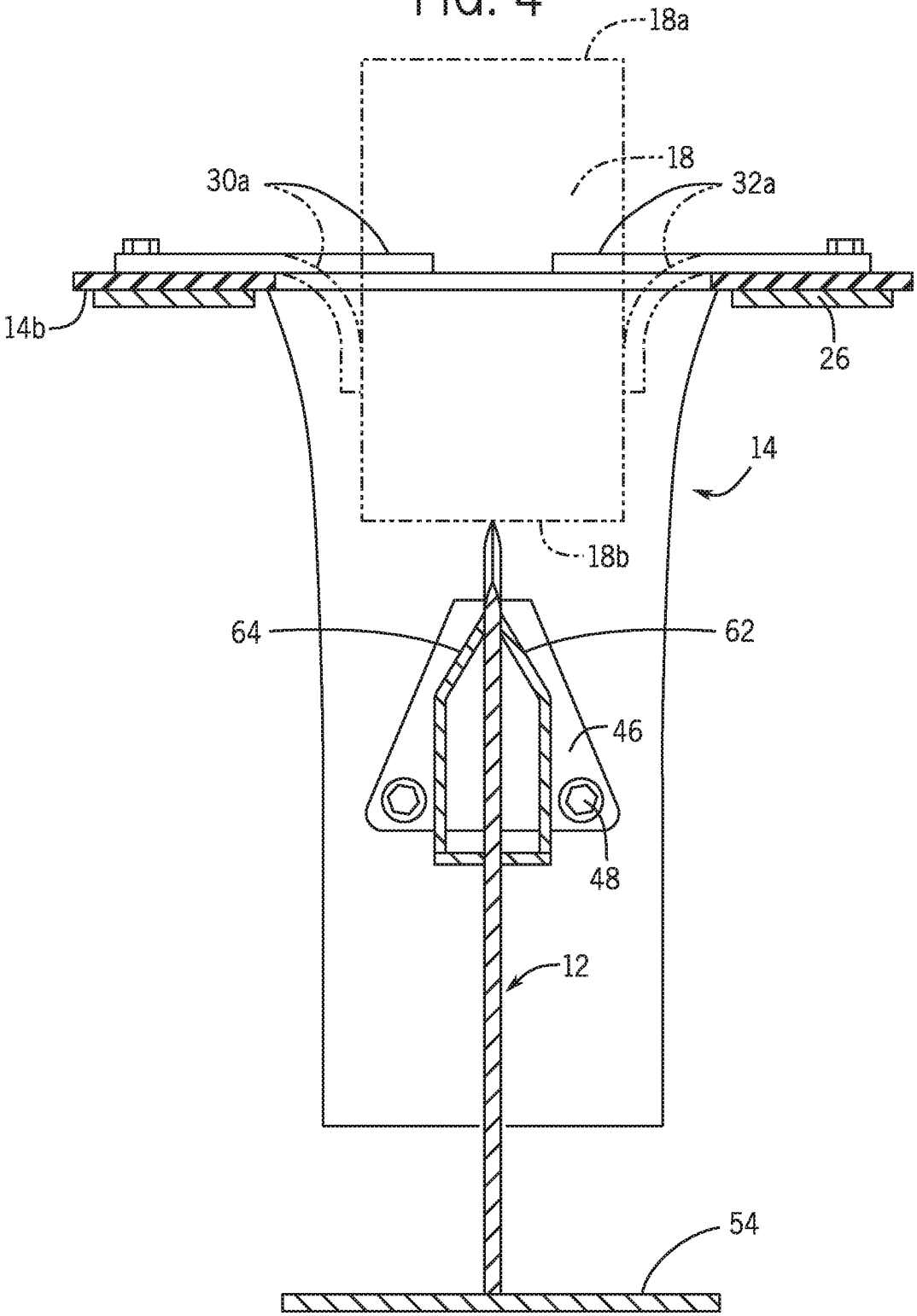
FIG. 4 is a cross-section view taken along the line 4-4 of FIG. 1.

Referring now to the drawings wherein the showings are for purposes of illustrating one or more exemplary embodiments and not for purposes of limiting the same, FIG. 1-4 shows a log splitter apparatus for splitting logs that is generally designated by reference 10. In the illustrated exemplary embodiment, the log splitter apparatus 10 includes an upward facing wedge or blade 12 and a shroud 14 secured to the upward facing wedge 12. As shown, the shroud 14 has a positioning aperture 16 defined therein that is positioned over the upward facing wedge 12 to position an associated log (e.g., log 18 shown in FIGS. 3 and 4) on the upward facing wedge 12 for splitting of the associated log by the upward facing wedge 12 when a downward force is applied to the associated log. In particular, such a downward force can be applied to log 18 at an upper end 18*a* of the log 18 that is opposite a lower or downward end 18*b* positioned at or adjacent the upward facing wedge 12 (as shown in FIG. 4). In the illustrated embodiment, the positioning aperture 16 is a round hole defined in an upper portion or top section 14*a* of the shroud 14, though this is not required and other shapes and/or configurations can be used.

As shown in the illustrated embodiment, the shroud 14 is spaced apart from the upward facing wedge 12 and shaped to inhibit contact between an associated hammer tool 20 used to apply the downward force to the upper end 18*a* of the log and the upward facing wedge 12 (i.e., the shroud 14 can prevent or reduce the likelihood of contact between the hammer tool 20 and the upward facing wedge 12). As shown, the hammer tool 20 can be a sledge hammer (e.g., an 8 lb. sledge hammer) or some other suitable tool for applying blunt force to the upper end of a log section.

To support the shroud 14, the log splitter apparatus 10 can additionally include a frame 22 connecting the upward facing wedge 12 to the shroud 14. In the illustrated embodiment, the frame 22 includes a rearward arm 24 extending from a rear edge 12*a* of the upward facing wedge 12 to the top section 14*a* of the shroud 14 to position the top section 14*a* relative to an upper extent 12*b* of the upward facing wedge 12. The frame 22 can further include an upper frame member 26 (best shown in FIGS. 3 and 4) supporting an underside 14*b* of the top section 14*a* of the shroud 14. As shown in FIG. 3, in the illustrated embodiment, the upper frame member 26 can extend along the underside 14*b* at locations rearward of the positioning aperture 16 (i.e., to the left in FIG. 3 of the positioning aperture 16) and on each lateral side of the positioning aperture 16 (i.e., above and below the positioning aperture 16 in FIG. 3) to provide underside support to the top section 14*a* of the shroud 14, or at least to a portion of the top section 14*a*.

As shown, the upper frame member 26 can terminate adjacent a location or area 28 forward of the positioning aperture 16 (i.e., to the right of the positioning aperture 16 in FIG. 3) such that the upper frame member 26 is absent from the underside 14*b* of the top section 14*a* at the location 28 forward of the positioning aperture 16. In particular, the upper frame member 26 includes terminal ends 26*a*, 26*b* that are circumferentially spaced apart from one another to define the location 28 forward of the positioning aperture 16 at which no upper frame member 26 is provided below the top section 14*a* of the shroud 14. Though not shown, the upper frame member 26 can be welded or otherwise fixably secured to the rearward arm 24 for supporting the top section 14*a* of the shroud 14.

Figure 1:
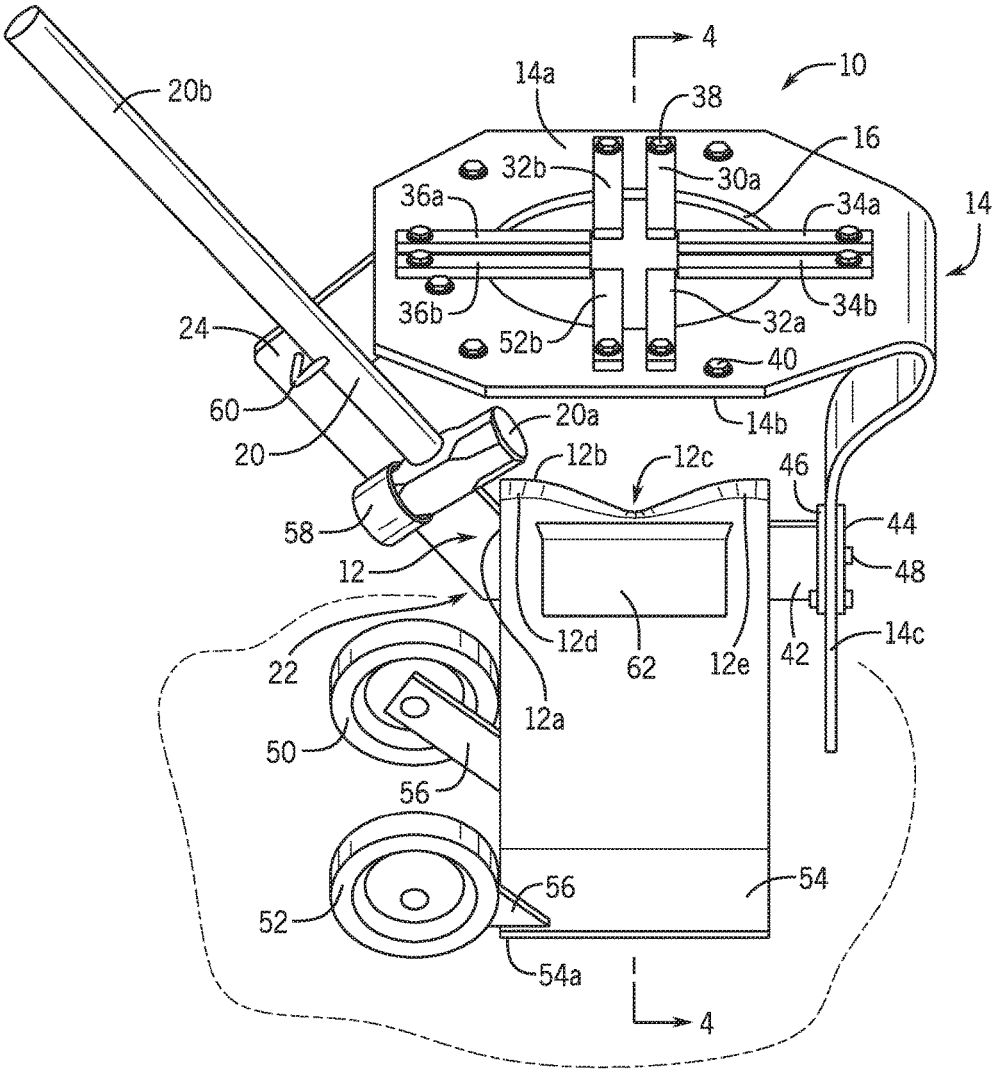
FIG. 1 is a side perspective view of a log splitter apparatus according to one exemplary embodiment.
Figure 2:
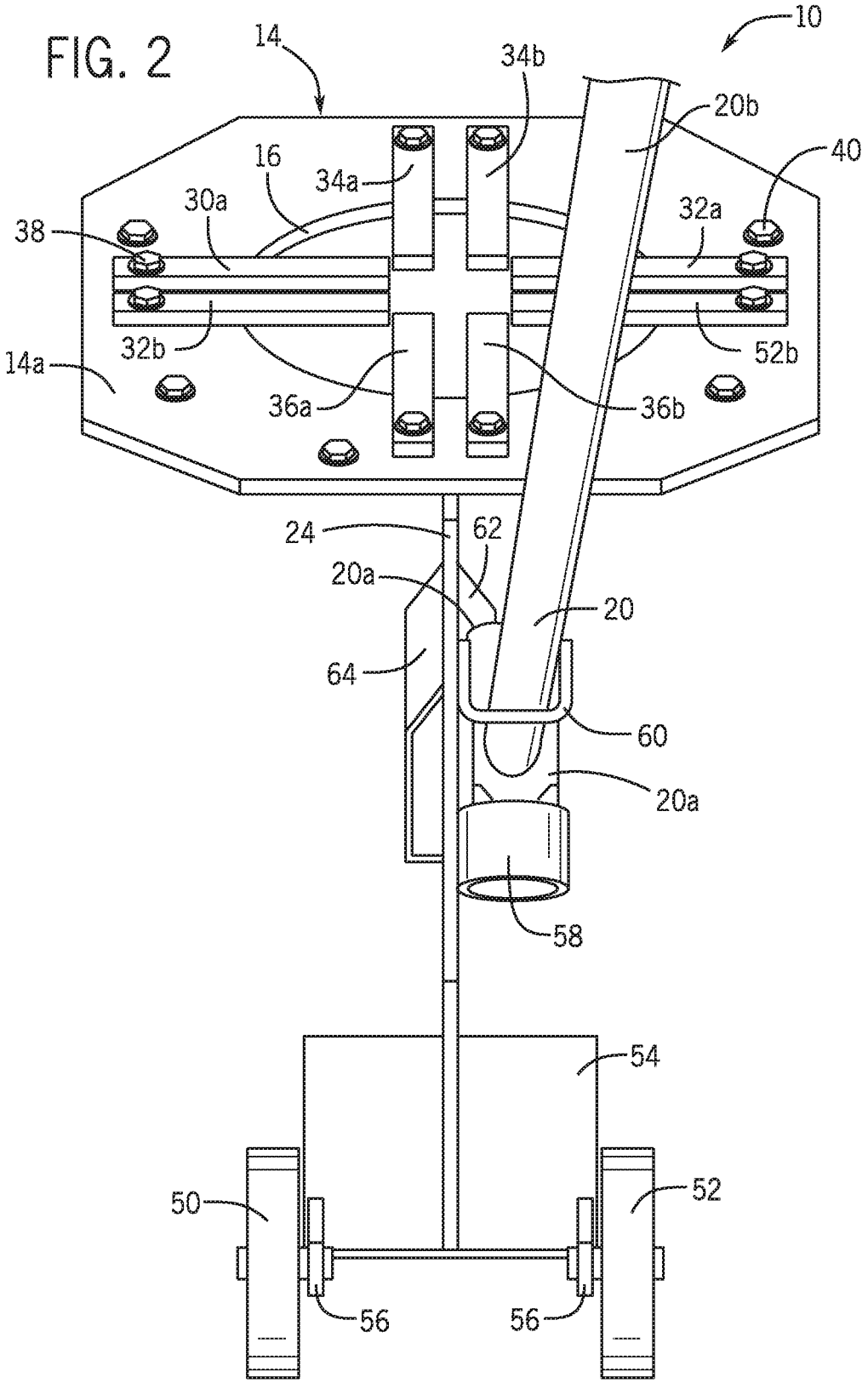
FIG. 2 is a rear perspective view of the log splitter apparatus of FIG. 1.

In addition to the top section 14*a*, which is arranged generally horizontally and spaced apart vertically from the upward facing wedge 12, the shroud 14 can further include a forward portion or section 14*c* arranged generally vertically and spaced apart forward of the upward facing wedge 12 (i.e., to the right of the upward facing wedge 12 in FIG. 1). In one exemplary embodiment, the shroud 14 is formed of a resilient material, such as rubber. In addition, and only as a non-limiting example, the rubber shroud can be ¼ of inch thick, though other thicknesses could be used. In the same or an alternative embodiment, and only as another non-limiting example, the shroud could be formed from the rubber mat product sold under the tradename AgriMat™ by SuperMats Inc. of Elk River, Minn., though of course other rubber products could be used. As will be described in more detail below, the shroud 14 being formed of a resilient material provides some protection via inhibiting contact between the hammer tool 20 and the upward facing wedge 12. Further, striking of the shroud 14 with the hammer tool 20 will, whether struck fully or partially, result in a cushioned impact relative to the impact that would occur if the shroud 14 were formed of a more ridged material (e.g., of a metal or metal alloy, such as steel or aluminum); however, the shroud is less susceptible to breakage than it would be if formed of some other less rigid material (e.g., a plastic or a rigid composite material).

The shroud 14 being formed of the resilient material, and particularly the upper portion 14*a* of the shroud 14 being formed of a resilient material, in combination with the upper frame member 26 terminating at the terminal ends 26*a*, 26*b*, provides for the area 28 forward of the positioning aperture 16 to be more accepting or forgiving of strikes by the hammer tool 20. In operation, this is the location at which the greatest likelihood of striking of the shroud 14 is present when splitting logs 18 in the log splitter apparatus 10 (presuming a user is positioned forward of the log splitter apparatus). Thus, the absence of the upper frame member 26 at the location or area 28 and the resilient material used for the shroud 14 increases the resilient flexibility imparted to the shroud 14 at the location forward of the positioning aperture 16.

The log splitter apparatus 10 of the illustrated embodiment can further include at least one finger extending radially into the positioning aperture 16 to secure a relative location of the log 18 relative to the upward facing wedge 12 when the log 18 is received within the positioning aperture 16. More particularly, the at least one finger can include at least two circumferentially spaced part fingers extending radially into the positioning aperture 16 to secure the relative location of the log 18. Further, the at least two circumferentially spaced apart fingers can include at least a first circumferentially spaced apart finger (e.g., finger 30*a*) disposed diametrically opposite at least a second circumferentially spaced apart finger (e.g., finger 32*a*). In the illustrated embodiment, the at least one finger includes a first set of fingers 30*a*, 30*b* extending radially inwardly and a second set of fingers 32*a*, 32*b* extending radially inwardly toward the first set of fingers 30*a*, 30*b*. The first and second sets of fingers 30*a*, 30*b*, 32*a*, 32*b* can be located diametrically opposite one another relative to the positioning aperture 16.

Additionally, in the illustrated embodiment, the at least one finger can further include a third set of fingers 34*a*, 34*b* extending radially inwardly and a fourth set of fingers 36*a*, 36*b* extending radially inwardly toward the third set of fingers 34*a*, 34*b*. The third and fourth sets of fingers 34*a*, 34*b*, 36*a*, 36*b* can be located diametrically opposite one another relative to the positioning aperture 16 and can be angularly offset ninety degrees (90°) relative to the first and second sets of fingers 30*a*, 30*b*, 32*a*, 32*b*. The fingers 30*a*-36*b* can each be formed of a resilient material, such a the same resilient material used to form the shroud 14, that flexibly moves when the log 18 is inserted into the positioning aperture 16 to align the log 18 with the upward facing wedge 12. It will be appreciated by those skilled in the art that fewer than the eight fingers shown in the illustrated embodiment can be used or more than the eight fingers shown in the illustrated embodiment can be used.

The fingers 30*a*, 30*b* can be bolted via bolts 38 to the top section 14*a* of the shroud 14, and, optionally, to the upper frame member 26. Likewise, bolts 40 can be used for fixably securing the top section 14*a* of the shroud 14 to the upper frame member 26. The frame 22 can further include a forward arm 42 to which the forward section 14*c* of the shroud 14 can be fixably secured. In particular, mounting flanges 44, 46 can sandwich the forward section 14*c* of the shroud 14 and bolts 48 can secure the forward section 14*c* to the mounting flanges 44, 46.

To facilitate portability of the log splitter apparatus 10, the log splitter apparatus 10 can further include at least one wheel (e.g., wheels 50, 52) about which the frame 22 is pivotable to a towing position for enabling pulling transport of the frame 22 and thus the log splitter apparatus 10. In the illustrated embodiment, the at least one wheel includes a pair of wheels 50, 52 mounted rearwardly on the frame 22. In particular, the frame 22 can include a base 54 to which the wheels 50, 52 are rotatably mounted, such as near a rearward end 54*a* of the base 54. In the illustrated embodiment, wheel mounting brackets 56 extend rearwardly from the base 54 for mounting of the wheels 50, 52, as shown.

By this arrangement, the frame 22 can be pivoted about the wheels 50, 52 and then rolled via the wheels 50, 52 while in the pivoted or towing position. As shown, the rearward arm 24 can include at least one structure (e.g., structures 58, 60) that carries the hammer tool 20 and enables the hammer tool 20 to operate as a pulling handle for the frame 22 when the frame 22 is pivoted to the towing position about the wheels 50, 52. In particular, in the illustrated embodiment, a structure 58 defining an aperture receives the head portion 20*a* of the hammer tool and a structure 60 in the form of an L-shaped bracket supports a handle portion 20*b* of the hammer tool 20 thereby enabling a user to grasp the handle portion 20*b*, such as near a distal end thereof, to tow the log splitter apparatus 10 via the wheels 50, 52.

As best shown in FIGS. 1 and 4, the upward facing wedge 12 has the upper extent 12*b* formed as a cutting edge with a central depression 12*c* to reduce a contact area between the cutting edge 12*b* and the log 18 when the log 18 is initially inserted into the positioning aperture 16 and the lower end 18*b* contacts the upward facing wedge 12 (i.e., the position shown in FIG. 4). More particularly, the cutting edge 12*b* includes raised lateral or flanking portions 12*d*, 12*e* with the central depression 12*c* formed therebetween. This enables only the raised lateral portions 12*d*, 12*e* to initially contact the lower end 18*b* of log 18 and allows for easier setting of the log 18 onto the upward facing wedge 12. More particularly, setting involves applying the downward force to the upper end 18*a* of the log 18 to cause the upward facing wedge 12, and particularly the cutting edge 12*b* thereof, to penetrate into the lower end 18*b* of the log 18.

Additionally, the upward facing wedge 12 can include wedge projections 62, 64 extending laterally outwardly for splitting the log 18. More particularly, upper extents 62*a*, 64*a* of the wedge projections 62, 64 are spaced apart vertically below the cutting edge 12*b* of the upward facing wedge 12. Accordingly, the cutting edge 12*b* (and a portion of the upward facing wedge 12 below the cutting edge 12*b*) can penetrate and insert into the lower end 18*b* of the log 18 to fix the log 18 onto the upward facing wedge 12 and then the wedge projections 62, 64 can force apart the log 18 as downward force is applied to the upper end 18*a* of the log via the hammer tool 20.

In the illustrated embodiment, the upward facing wedge 12 forms a part of the frame 22. More particularly, the rearward arm 24 connects directly to the upward facing wedge 12 as does the forward arm 42 and the base 54. In alternate embodiments (not shown), the upward facing wedge 12 can be a separate member or component that is secured to the frame 22 and need not itself directly connect to the various components (e.g., the rearward arm 24, the forward arm 42, and/or the base 54) of the frame 22.

Figure 5:
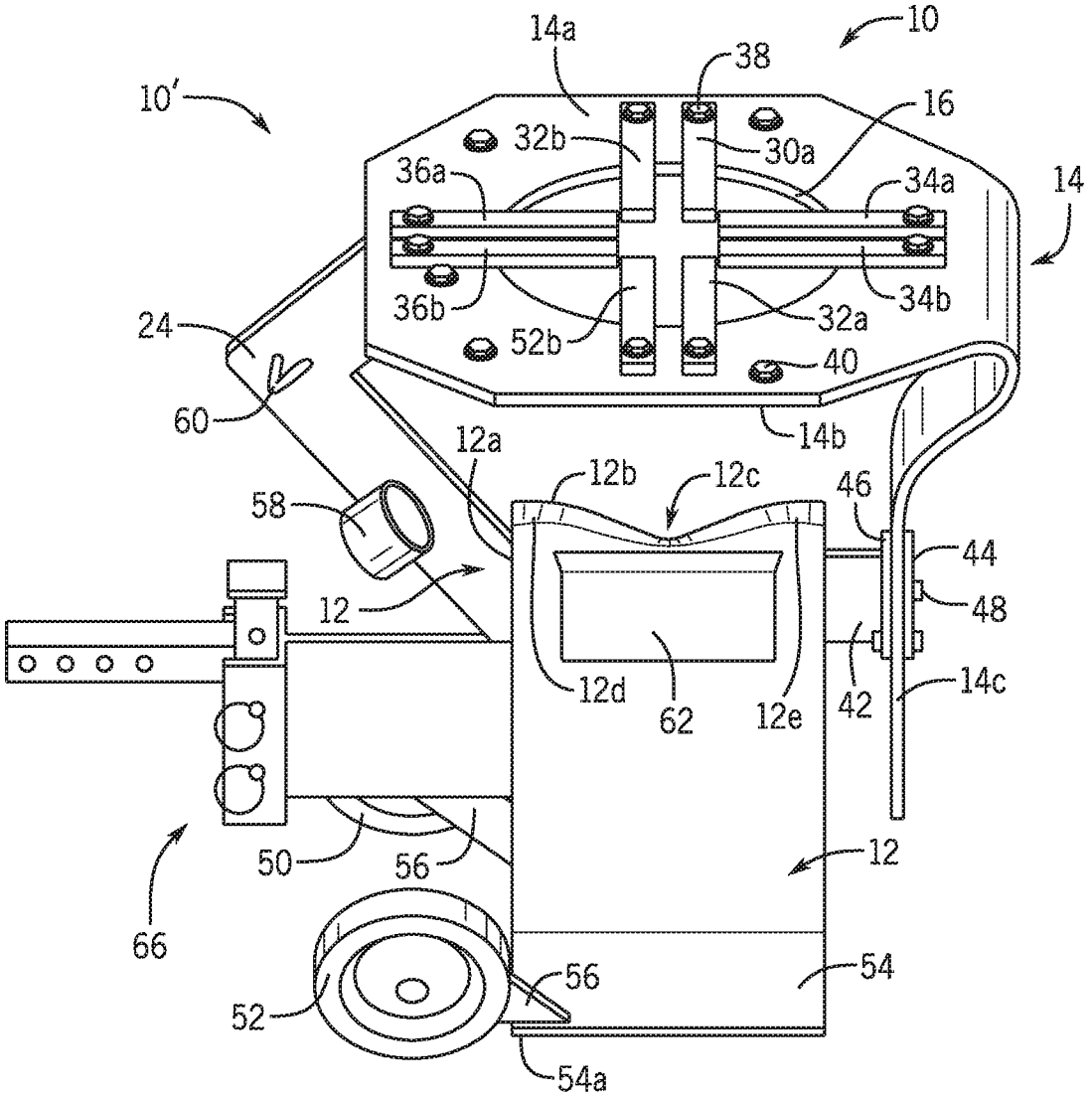
FIG. 5 is a side perspective view of another log splitter apparatus according to an alternate exemplary embodiment.

With reference to FIG. 5, a log splitter apparatus 10' is shown according to an alternate exemplary embodiment. In most respects, the log splitter apparatus 10' can be the same or similar to the log splitter apparatus 10 except as indicated hereinbelow. One difference is that the log splitter apparatus 10' can include a towing hitch extension member or assembly 66 connected to the upward facing wedge 12 (or to the frame 22) to enable the log splitter apparatus 10' to be connected to an associated vehicle towing hitch (not shown) for transport of the log splitter apparatus 10'. It is contemplated that the towing hitch extension member 66 can be arranged so that when the log splitter apparatus 10' is connected to a vehicle's towing hitch, the log splitter apparatus 10' can be spaced vertically above the ground and carried by the vehicle's towing hitch.

A log splitter method for splitting logs will now be described according to an exemplary embodiment. In particular, the log splitter method will be described in association with the log splitter apparatus 10 of FIGS. 1-4, though it is to be understood and appreciated the log splitter method could be used with other log splitter devices. In the method, log splitter apparatus 10 is provided having the upward facing wedge 12 and the shroud 14 secured to the upward facing wedge 12. The log 18 to be split is inserted into the positioning aperture 16 defined by the shroud 14 over the upward facing wedge 12 to position the log 18 on the upward facing wedge 12 for splitting thereof.

A downward force is applied to the upper end 18*a* of the log 18 to force the log 18 downward into the upward facing wedge 12 to split the log 18. The application of the downward force can include applying a first downward force to set the log 18 onto the upward facing wedge 12 and can include applying a second downward force to split the log 18 with the upward facing wedge 12. As already discussed herein, the upward facing wedge 12 can have cutting edge 12*b* with central depression 12*c* that is initially spaced apart from the log 18 when the log 18 contacts the upward facing wedge 12. In the method, the application of the downward force is cushioned when the downward force is at least partially applied against the shroud 14 for the reasons discussed hereinabove. For example, the shroud 14 being formed of a resilient material, the absence of the upper frame member 26 at the area 28, etc.

Figure 6:
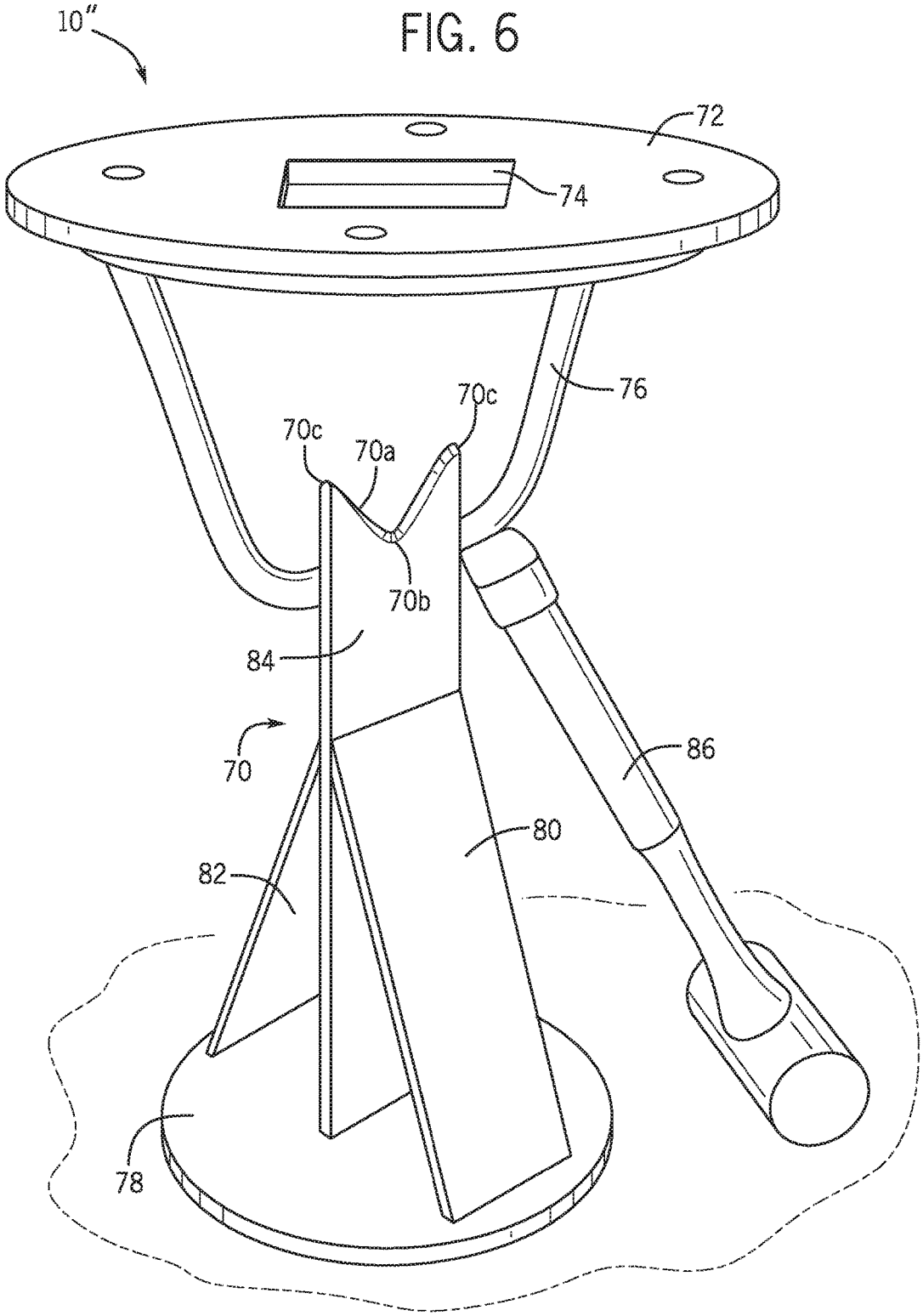
FIG. 6 is a perspective view of yet another log splitter apparatus according to a further alternate exemplary embodiment.

With reference to FIG. 6, a log splitter apparatus 10" is shown according to yet another alternate exemplary embodiment. The log splitter apparatus 10" can be used for splitting small logs or kindling. In particular, the log splitter apparatus 10" can include an upward facing wedge 70 and a shroud 72 spaced apart vertically above the upward facing wedge 70. The shroud 72 can define a positioning aperture 74 positioned directly above the upward facing wedge 70. A frame 76 can support the shroud 72 in the spaced apart position above the upward facing wedge 70. A base 78 can be provided for supporting the upward facing wedge 70. In the illustrated embodiment the upward facing wedge 70 includes a cutting edge 70*a* having a central depression 70*b* and laterally projecting sections 70*c*, 70*d*. In most respects, the cutting edge 70*a* can function the same or similar to the cutting edge 12*b* of the log splitter apparatus 10. Splitting members 80, 82 can be angularly oriented relative to a central blade member 84 for splitting any logs or kindling forced against the upward facing wedge 70, wherein the application of downward force can be applied via a suitable hammer tool, such as the illustrated handheld, small sledgehammer 86 (e.g., a 5 lb. sledge hammer).

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A log splitter apparatus for splitting logs, comprising: an upward facing wedge; and a shroud secured to the upward facing wedge, the shroud having a positioning aperture defined therein that is positioned over the upward facing wedge to position an associated log on the upward facing wedge for splitting of the associated log by the upward facing wedge when a downward force is applied to the associated log at an upper end of the associated log that is opposite a downward end positioned at or adjacent the upward facing wedge; and at least two circumferentially spaced apart elongated finger extending radially into the positioning aperture to secure a relative location of the associated log relative to the upward facing wedge when the associated log is received within the positioning aperture.

2. The log splitter apparatus of claim 1 wherein the at least two circumferentially spaced apart fingers includes at least a first circumferentially spaced apart finger disposed diametrically opposite at least a second circumferentially spaced apart finger.

3. The log splitter apparatus of claim 1 wherein the at least two fingers includes a first set of fingers extending radially inwardly and a second set of fingers extending radially inwardly toward the first set of fingers, the first and second sets of fingers located diametrically opposite one another relative to the positioning aperture.

4. The log splitter apparatus of claim 1 wherein the at least two fingers is formed of a resilient rubber material that flexibly moves when the associated log is inserted into the positioning aperture to align the associated log with the upward facing wedge.

5. The log splitter apparatus of claim 1 wherein the shroud is formed of a resilient rubber material, the shroud spaced apart from the upward facing wedge and shaped to inhibit contact between an associated hammer tool used to apply the downward force to the upper end of the associated log and the upward facing wedge.

6. The log splitter apparatus of claim 5 further including a frame connecting the upward facing wedge to the shroud, the frame including:

a rearward arm extending from a rear edge of the upward facing wedge to a top section of the shroud to position the top section relative to an upper extent of the upward facing wedge.

7. A log splitter apparatus for splitting logs, comprising:

an upward facing wedge;

a shroud secured to the upward facing wedge, the shroud having a positioning aperture defined therein that is positioned over the upward facing wedge to position an associated log on the upward facing wedge for splitting of the associated log by the upward facing wedge when a downward force is applied to the associated log at an upper end of the associated log that is opposite a downward end positioned at or adjacent the upward facing wedge, the shroud formed of a resilient rubber material, the shroud spaced apart from the upward facing wedge and shaped to inhibit contact between an associated hammer tool used to apply the downward force to the upper end of the associated log and the upward facing wedge; and a frame connecting the upward facing wedge to the shroud, the frame including a rearward arm extending from a rear edge of the upward facing wedge to a top section of the shroud to position the top section relative to an upper extent of the upward facing wedge, wherein the frame further includes:

an upper frame member supporting an underside of the top section of the shroud, the upper frame member extending along the underside at locations rearward of the positioning aperture and on each lateral side of the positioning aperture to provide underside support to the top section of the shroud, the upper frame member terminating adjacent a location forward of the positioning aperture such that the upper frame member is absent from the underside of the top section at the location forward of the positioning aperture to increase resilient flexibility to the shroud at the location forward of the positioning aperture.

8. The log splitter apparatus of claim 6 further including at least one wheel about which the frame is pivotable to a towing position for enabling rolling transport of the frame.

9. The log splitter apparatus of claim 8 wherein the rearward arm includes at least one structure that carries a hammer tool and enables the hammer tool to operate as a pulling handle for the frame.

10. The log splitter apparatus of claim 5 wherein the shroud includes a top section arranged generally horizontally and spaced apart vertically from the upward facing wedge and a forward section arranged generally vertically and spaced apart forward of the upward facing wedge.

11. The log splitter apparatus of claim 1 wherein a towing hitch extension member is connected to the upward facing wedge to enable the log splitter apparatus to be connected to an associated vehicle towing hitch for transport of the log splitter apparatus.

12. The log splitter apparatus of claim 1 wherein the upward facing wedge has a cutting edge with a central depression to reduce a contact area between the cutting edge and the associated log when the associated log is initially inserted into the positioning aperture and the downward end of the associated log contacts the upward facing wedge.

13. The log splitter apparatus of claim 12 wherein the upward facing wedge has wedge projections extending laterally outwardly for splitting the associated log, upper extents of the wedge projections spaced apart below the cutting edge of the upward facing wedge.

14. A log splitter method for splitting logs, comprising:

providing a log splitter apparatus having an upward facing wedge and a shroud secured to the upward facing wedge;

inserting a log to be split into a positioning aperture defined by the shroud over the upward facing wedge to position the log on the upward facing wedge for splitting thereof;

positioning the loci centrally in the positioning aperture by at least two circumferentially spaced fingers extending radially into the positioning aperture; and applying a downward force to an upper end of the log to force the log downward into the upward facing wedge to split the log.

15. The log splitter method of claim 14 wherein applying the downward force includes:

applying a first downward force to set the log onto the upward facing wedge, the upward facing wedge having a cutting edge with a central depression that is initially spaced apart from the log when the log contacts the upward facing wedge; and applying a second downward force to split the log with the upward facing wedge.

16. The log splitter method of claim 14 further including:

cushioning the application of the downward force when the downward force is at least partially applied against the shroud via a shroud being formed of a resilient rubber material.

17. A splitter apparatus for splitting logs, comprising:

an upward facing wedge; and a shroud connected to the upward facing wedge by a rigid frame member, the shroud defining a positioning aperture directly above the upward facing wedge, the shroud inhibiting contact with the upward facing wedge and the shroud is formed from a stiff resilient material that is more resilient and non-rigid than the frame member;

at least two circumferentially spaced apart elongated finger extending radially into the positioning aperture to secure a relative location of the associated log relative to the upward facing wedge when the associated log is received within the positioning aperture.

18. The log splitter apparatus of claim 9 wherein said at least one structure includes an aperture defining structure disposed on the rearward arm that receives a head portion of the hammer tool and an L-shaped bracket disposed on the rearward arm and spaced apart from the aperture defining structure to support a handle portion of the hammer tool whereby the handle portion extends beyond the extension arm to enable a user to grasp a distal end of the handle portion to tow the log splitter apparatus.

* * * * *